US009322229B2

(12) United States Patent
Taylor

(10) Patent No.: US 9,322,229 B2
(45) Date of Patent: Apr. 26, 2016

(54) SLIP

(71) Applicant: BALLTEC LIMITED, Lancashire (GB)

(72) Inventor: Richard James Taylor, Cumbria (GB)

(73) Assignee: BALLTEC LIMITED, The Gateway, White Lund Industrial Estate Morecambe, Lancashire (GB)

( * ) Notice: Subject to any disclaimer, the term of this patent is extended or adjusted under 35 U.S.C. 154(b) by 0 days.

(21) Appl. No.: 14/404,511

(22) PCT Filed: Jun. 11, 2013

(86) PCT No.: PCT/GB2013/051531
§ 371 (c)(1),
(2) Date: Nov. 28, 2014

(87) PCT Pub. No.: WO2013/186549
PCT Pub. Date: Dec. 19, 2013

(65) Prior Publication Data

US 2015/0115637 A1 Apr. 30, 2015

(30) Foreign Application Priority Data

Jun. 11, 2012 (GB) ..... 1210220.8

(51) Int. Cl.
*E21B 19/10* (2006.01)
*B66C 1/44* (2006.01)

(52) U.S. Cl.
CPC .. *E21B 19/10* (2013.01); *B66C 1/44* (2013.01)

(58) Field of Classification Search
CPC ..... E21B 19/10; B66C 1/44; B66C 1/442
USPC ..... 294/86.4, 102.1, 102.2, 114, 119.2, 294/902; 279/22
See application file for complete search history.

(56) References Cited

U.S. PATENT DOCUMENTS

| | | | | |
|---|---|---|---|---|
| 901,925 | A * | 10/1908 | Thompson | 294/86.4 |
| 1,490,451 | A * | 4/1924 | Brown | 294/86.31 |
| 1,829,760 | A * | 11/1931 | Santiago | 294/86.22 |
| 3,008,749 | A * | 11/1961 | Gowan | 294/86.4 |
| 3,197,250 | A * | 7/1965 | Trotta et al. | 294/102.1 |
| 3,780,923 | A * | 12/1973 | Merola | 226/151 |
| 4,353,537 | A * | 10/1982 | Koufos | 269/266 |
| 7,552,764 | B2 * | 6/2009 | Weems et al. | 166/85.1 |
| 2002/0144575 | A1 | 10/2002 | Niven | |

FOREIGN PATENT DOCUMENTS

| | | |
|---|---|---|
| CN | 202300242 | 7/2012 |
| DE | 4333513 A1 | 4/1996 |

(Continued)

OTHER PUBLICATIONS

UK Search Report, Application No. GB 1210220.8, dated Sep. 19, 2012.

*Primary Examiner* — Dean Kramer
(74) *Attorney, Agent, or Firm* — Barlow, Josephs & Holmes, Ltd.

(57) ABSTRACT

A slip for supporting a member, such as a pipe. The slip comprises one or more rolling elements, such as roller, for gripping the member. The rolling elements may contact each other. The slip may be formed from a plurality of pivotally connected segments. The rolling elements may be arranged to roll along ramps, arranged to urge the members into contact with a member to be gripped.

20 Claims, 3 Drawing Sheets

(56) References Cited

FOREIGN PATENT DOCUMENTS

| | | | |
|---|---|---|---|
| GB | 2146091 | A | 4/1985 |
| GB | 2220018 | A | 12/1989 |
| GB | 2338008 | A | 12/1999 |
| WO | WO2009/025832 | A1 | 2/2009 |
| WO | WO2009/156764 | A1 | 12/2009 |

* cited by examiner

SLIP

TECHNICAL FIELD OF THE INVENTION

The present invention relates to a slip. The invention relates particularly, but not exclusively, to a slip for use in the drilling industry for handling tubing, drill pipe, drill collar, wash pipe, casing or other members.

BACKGROUND TO THE INVENTION

Slips comprise a plurality of metal wedges, often referred to as segments, which are used to support substantially cylindrical members such as well casing in an aperture, typically a bowl shaped aperture extending through a drill floor of a drilling rig. Conventional slips have sharpened teeth with a machined or grit finish arranged to grip the casing or other member to be supported.

A significant problem with these conventional slips is that the teeth damage the surface of the member they are used to support. This damage can affect the strength and integrity of the member. It may cause fatigue and lead to stress corrosion.

Embodiments of the present invention have been made in consideration of this problem.

SUMMARY OF THE INVENTION

According to a first aspect of the present invention there is provided a slip for supporting a member, the slip comprising one or more rolling elements for gripping the member, wherein said rolling elements may contact each other and may roll along a surface of the slip.

Rolling elements can be used to grip a member by arranging the rolling elements on suitably profiled ramps so that the weight of a member being gripped and supported by a slip causes the or each rolling member to move along the ramp in such a way as to urge the or each rolling element into contact with the member. The profile of a rolling element is, however, much less likely to damage the surface of a member being gripped, as compared to the teeth of conventional slips. Thus, the invention provides for the manufacture of slips which are less damaging to members such as casings and drill pipe than conventional slips.

The or each rolling member may be associated with a ramp. Where provided, the or each ramp may be arranged so that in use it urges the associated rolling element into contact with a member supported by the slip. The or each rolling element may be a roller. The roller may have a substantially cylindrical shape. Rolling elements may be arranged in a plurality of substantially parallel rows. In one arrangement rollers are arranged in a row one above the other, the axis of rotation of each roller being substantially parallel, but spaced apart.

The or each rolling element may be retained in a slot and may move along a slot between a gripping position and a release position. Where the or each rolling element is a roller, the roller may comprise a spigot, or spigots one on either end of the roller, the or each spigot being retained for movement in a slot.

Means may be provided arranged to urge the or each rolling element towards a release position. Means may also be provided arranged to urge the or each rolling element to a gripping position. The means for urging, in each case, may comprise a sliding pin and the sliding pin may be urged into contact with a rolling element by a resilient member. The resilient member may be a compression spring, in particular a helical spring. Where a plurality of rolling elements are arranged in a row means arranged to urge the elements in the row towards the release position may be disposed at one end of the row, and means arranged to urge the members towards the gripping position may be disposed at the other end of the row. The means arranged to urge the rolling elements towards the release position may exert a larger force than the means arranged to urge the elements towards the gripping position. The result is that the rolling elements are held in contact with other, and there is a new bias towards the release position.

The slip may comprise a plurality of pivotally connected segments, each segment comprising one or more rolling elements. Each segment may comprise one or a plurality of rows of rolling elements.

According to another aspect of the present invention there is provided a slip segment for use in a slip for supporting a member, the slip segment comprising one or more rolling elements for gripping the member, wherein said rolling elements may contact each other and may roll along a surface of the slip segment.

DETAILED DESCRIPTION OF THE INVENTION

In order that the invention may be more clearly understood an embodiment thereof will now be described, by way of example only, with reference to the accompanying drawings, of which:

Figure 1:
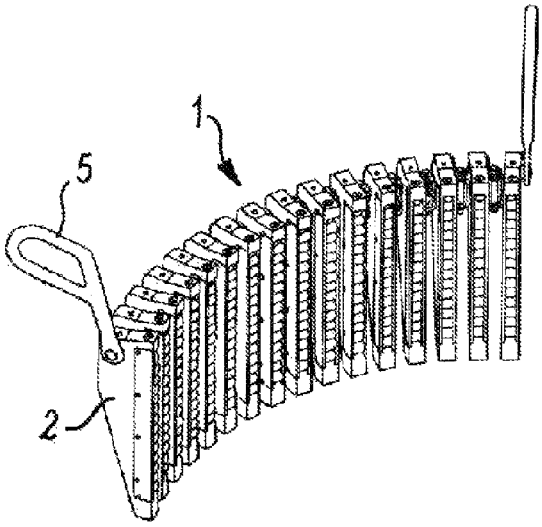
FIG. 1 is a perspective view of a slip according to the invention in an open state.
Figure 2:
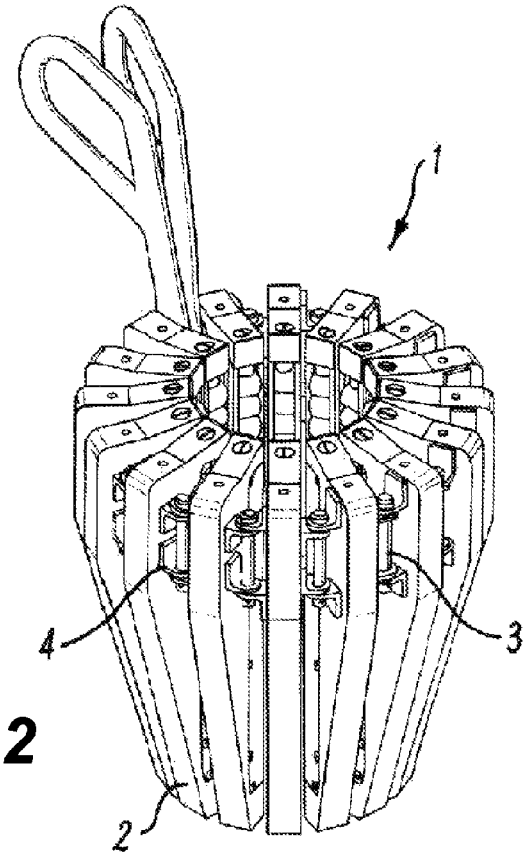
FIG. 2 is a perspective view of the slip of FIG. 1 in a closed state.
Figure 3:
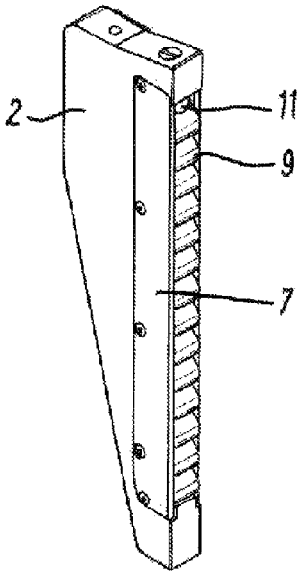
FIG. 3 is a perspective view of a single segment of the slip of FIG. 1.
Figure 4:
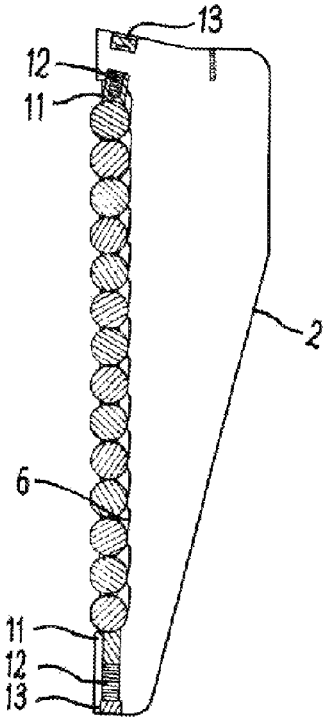
FIG. 4 is a side view of the segment of FIG. 3 with a plate removed.
Figure 5:
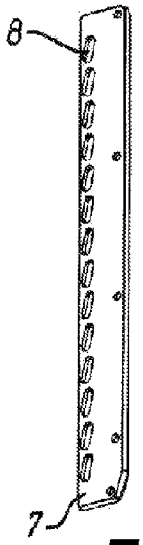
FIG. 5 is a view of the inside surface of the plate removed from the segment shown in FIG. 3.
Figure 6:
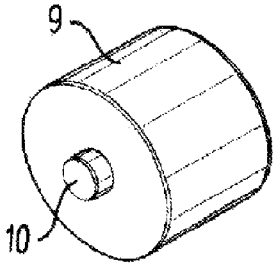
FIG. 6 is a perspective view of a roller of the segment of FIG. 3

In the following the terms upper, lower, top, bottom and like terms are used to refer to the described apparatus in the orientation in which it is shown in the accompanying drawings, which is the orientation in which it is intended to be used. The terms should not be taken as otherwise limiting.

Referring to the drawings a slip 1 comprises a plurality of pivotally connected metal segments 2. The segments are connected by pins 3 extending through apertures in brackets 4 mounted to the sides of the segments 1. The segments at opposite ends of the connected segments are each fitted with a respective handle 5. The handles facilitate handling of the slip and, in particular, enable the ends of the slip to be brought together to bring the slip into a closed state in which it may encircle a member, such as a drill casing, to be supported by the slip. The features described thus far are common to conventional slips and so will not be elaborated further.

Each segment 2 of the slip comprises a metal, typically steel, body. The side of the segment, which is, in use, intended to face a member to be supported by the slip has a recessed portion extending between upper and lower ends of the body. The surface 6 of the recessed portion has a generally dog-toothed profile, formed by a plurality of adjacent ramps, each of which are angled so that their lower ends extend further from the body than their upper ends. A respective plate 7 is bolted, or fastened in some other appropriate way, to each side of the body of the segment and extends over the length of the recessed portion. A plurality of elongate, spaced apart, parallel slots 8 are formed in the facing (inside) surfaces of the two plates 7. A respective slot is provided in each plate for each of the ramps formed on the recessed portion of the body of the segment and the slots are positioned so that when the plates are affixed to the body of the segment each slot lies adjacent to a respective ramp. The slots each extend in a direction which is generally parallel to the surface of their associated ramp.

The slots 8 are provided to mount hardened steel rollers 9 on the segment. Each roller has a cylindrical body with respective spigot 10 extending from each opposite end. In an assembled segment the roller spigots extend into the slots 8 in the plates 7 so the plates capture the rollers 9. The spigots 10 may move along the length of the slots, and the width of the slots is slightly greater than the diameter of the spigots to allow some movement across the width of the slots too. The slots 8 are positioned so that each roller is positioned adjacent a respective ramp on the segment body and can contact the ramp without the roller spigots bearing against the side of the slots in which they run.

In the segment body above and below the recessed portion there are formed two bores, one above and one below the recessed portion, in which are disposed sliding pins 11. In each case a compression spring 12, a helical spring in the illustrated example, is disposed behind the sliding pin and held in place by a spring retainer 13. The springs 12 urge the sliding pins 11 out of their respective bores and into contact with the adjacent rollers. The lower spring is significantly stronger than the upper spring, and it applies sufficient force to urge the rollers upwards in their slots against the force of the upper spring. Any suitable resilient members could be used other than springs.

Figure 8:
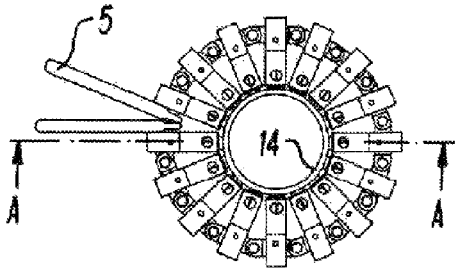
FIG. 8 is a plan view of the slip of FIG. 7 and tubular member.
Figure 7:
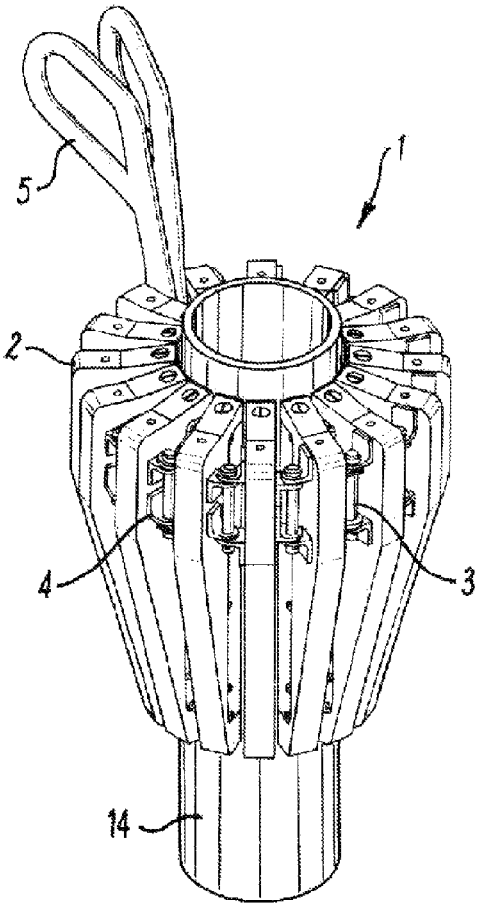
FIG. 7 is a perspective view of the slip of FIG. 1 in a closed state with a tubular member extending therethrough.
Figure 9:
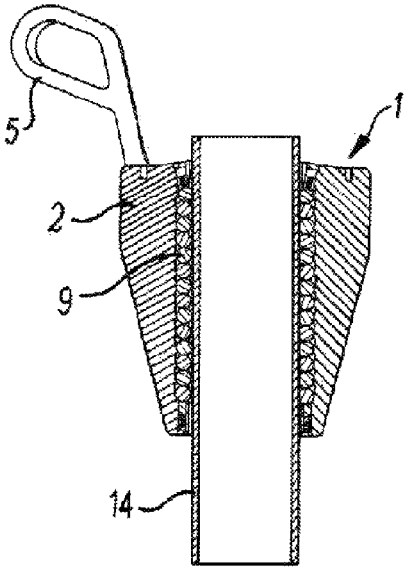
FIG. 9 is a cross-sectional view taken along the line A-A of FIG. 8.

When the slip is in use the rollers 9 provide the surface of the slip which grips a member to be supported, and replaces the toothed surface of conventional slips. In use the slip is moved into a closed configuration around a member to be held, such as the pipe 14 shown in FIGS. 7, 8 and 9, and the slip is placed into a bowl shaped aperture in a drill table. The profiled aperture in the drill table, and the outside surface of the slip urges the segments towards the surface of the pipe, and brings the rollers 9 into contact with the pipe.

Prior to contact of the rollers with a pipe the rollers will be urged upwards by the lower compression spring so that their spigots are disposed at the upper ends of the slots 8 and the rollers are adjacent the upper surfaces of their respective ramps, the release position. As support for the pipe from elsewhere, such as a hoist, is released the pipe will move, under its own weight, downwards through the slip. This causes the rollers 10 contacting the pipe to roll downwardly along their respective ramps and thus to be urged into contact with the surface of the pipe. Ideally, the pipe surface will contact all the rollers simultaneously and all of the rollers will move together as the weight of the pipe is taken up by the slip. To the extent that this does not happen, then a roller which does contact the pipe and roll along its ramp will bear upon rollers below it and move those rollers along their ramps any into contact with the pipe. As the rollers move down the segments the lowermost roller will urge the lower sliding pin 11 into its bore against the compression spring 12. Any rollers above a roller contacted by the pipe will be urged downwards along their respective ramps and into contact with the pipe by gravity under their own weight and also under the action of the upper compression spring, since engagement of a lower roller by the pipe will isolate the rollers above from the action of the lower compression spring. Thus, contact by all or most of the rollers with the pipe is ensured.

When the pipe is supported by the slip the weight of the pipe will be borne through the rollers to the ramps formed on the segment body. Owing to the clearance provided between the spigots 10 of the rollers 9 and the slots 8 no load will be transmitted through the spigots.

As the pipe is lifted again out of the slip the rollers will roll upwardly along their ramps and move away from the surface of the pipe, releasing the pipe. Movement of the rollers to their release position when the pipe is lifted is facilitated by the lower compression spring urging the rollers upwards, and overcoming the opposing force of the upper compression spring.

The use of rollers to grip a pipe or other member avoids the damage caused by the teeth of conventional slips. In fact, the generally square indentations which the rollers leave in a member which has been suspended from the slip are actually thought to reduce fatigue in the member as the action of the rollers is analogous to that of peening the member.

The above embodiment is described by way of example only. Many variations are possible without departing from the scope of the invention as defined in the appended claims.

The invention claimed is:

1. A slip for supporting a member, the slip comprising at least two rolling elements for gripping the member, wherein:

said rolling elements are configured and arranged to contact each other; and each rolling element is configured and arranged to roll along a different respective ramp on the surface of the slip.

2. A slip as claimed in claim 1 wherein each ramp is arranged so that in use it urges the associated rolling element into contact with a member supported by the slip.

3. A slip as claimed in claim 1 wherein each rolling element is a roller.

4. A slip as claimed in claim 1 having a plurality of rolling elements arranged in a plurality of substantially parallel rows.

5. A slip as claimed in claim 1 wherein each rolling element is retained in a slot and may move along the slot between a gripping position and a release position.

6. A slip as claimed in claim 5 wherein each rolling element is a roller having a spigot and the spigot is retained in the slot.

7. A slip as claimed in claim 5 comprising a means arranged to urge each rolling element towards the release position.

8. A slip as claimed in claim 7 wherein there is also a means arranged to urge each rolling element to the gripping position.

9. A slip as claimed in claim 8, wherein the means arranged to urge each rolling member towards the release position is disposed at one end of a row of rolling elements, and the means arranged to urge each rolling element towards the gripping position is disposed at the opposite end of the row.

10. A slip as claimed in claim 9 wherein the means arranged to urge the rolling elements towards the release position exerts a larger force than that arranged to urge the rolling elements towards the gripping position.

11. A slip as claimed in claim 7 wherein the means arranged to urge comprises a sliding pin urged into contact with a rolling element by a resilient member.

12. A slip as claimed in claim 1 comprising a plurality of pivotally connected segments, each segment comprising at least two rolling elements.

13. A slip as claimed in claim 12 wherein each segment comprises at least one row of rolling elements.

14. A slip for supporting a member, the slip comprising at least two rolling elements for gripping the member, wherein:

said rolling elements are configured and arranged to contact each other and are configured and arranged to roll along a surface of the slip;

each rolling element is retained in a slot and is arranged and configured to move along the slot between a gripping position and a release position; and each rolling element is a roller having a spigot and the spigot is retained in the slot.

15. A slip for supporting a member, the slip comprising at least two rolling elements for gripping the member, wherein:

said rolling elements are configured and arranged to contact each other and are configured and arranged to roll along a surface of the slip;

each rolling element is retained in a slot and is arranged and configured to move along the slot between a gripping position and a release position; and the slip further comprises a means arranged to urge each rolling element towards the release position.

16. A slip as claimed in claim 15 wherein each rolling element is a roller having a spigot and the spigot is retained in the slot.

17. A slip as claimed in claim 15 wherein there is also a means arranged to urge each rolling element to the gripping position.

18. A slip as claimed in claim 17 wherein the means arranged to urge each rolling member towards the release position is disposed at one end of a row of rolling elements, and the means arranged to urge each rolling element towards the gripping position is disposed at the opposite end of the row.

19. A slip as claimed in claim 18 wherein the means arranged to urge the rolling elements towards the release position exerts a larger force than that arranged to urge the rolling elements towards the gripping position.

20. A slip as claimed in claim 15 wherein the means arranged to urge comprises a sliding pin urged into contact with a rolling element by a resilient member.

* * * * *